United States Patent [19]

Tidström

[11] 4,391,179

[45] Jul. 5, 1983

[54] COMBAT VEHICLE

[75] Inventor: Erling Tidström, Karlskoga, Sweden

[73] Assignee: Aktiebolaget Bofors, Bofors, Sweden

[21] Appl. No.: 145,635

[22] Filed: May 1, 1980

[30] Foreign Application Priority Data

May 14, 1979 [SE] Sweden ..... 7904188

[51] Int. Cl.[3] ..... F41H 7/06

[52] U.S. Cl. ..... 89/46; 89/36 K

[58] Field of Search ..... 89/36 H, 36 K, 40 B, 89/46

[56] References Cited

U.S. PATENT DOCUMENTS

| | | | |
|---|---|---|---|
| 457,293 | 8/1891 | Spiller | 89/46 |
| 1,230,361 | 6/1917 | Allen | 89/36 K |
| 4,038,906 | 8/1977 | Tidstrom | 89/46 |

FOREIGN PATENT DOCUMENTS

| | | | |
|---|---|---|---|
| 2531936 | 3/1977 | Fed. Rep. of Germany | 89/46 |
| 100865 | 2/1941 | Sweden | 89/46 |
| 17595 | of 1913 | United Kingdom | 89/46 |

*Primary Examiner*—Stephen C. Bentley

*Attorney, Agent, or Firm*—Pollock, Vande Sande & Priddy

[57] ABSTRACT

A combat vehicle, for instance in the form of a tank, comprises a large-caliber firearm of 100 mm or more. The firearm is provided with an automatic loading device for separate-loading ammunition. Outside of the combat vehicle a magazine is arranged for holding charges, and inside the vehicle a crew position is permitting vision around the horizon. The vehicle is moreover made with a small frontal area.

6 Claims, 6 Drawing Figures

COMBAT VEHICLE

TECHNICAL FIELD

The present invention relates to a combat vehicle specifically a combat vehicle in the form of a tracked tank is provided.

BACKGROUND ART

A great number of combat vehicles are known, including a turret tank, tank with special suspension for the weapon carried, a tank with a miniturret, etc. In connection with these vehicles, it is known to utilize various types and calibers of firearms, and also various types of loading systems for the firearms. It is also common to man the tank with a certain number of crew members, and to give each crew member a position inside the vehicle which is dependent on the function which the crew member is assigned to perform. It is often necessary to resort to compromises which are related to the importance of the function in question and compromise among other functions may be necessary within the vehicle.

For a combat vehicle which requires substantial striking power, it is important to store the ammunition carried by the vehicle in such a way that a hit will not have far-reaching consequences. It is also of importance to be able to give the vehicle commander a position which permits vision around the horizon via his optical means. Further, a combat vehicle should be designed so that it has a small frontal area which makes it difficult to hit with enemy fire.

In the case of known combat vehicles the various problems can be solved individually, but the solution of one problem requires that some other problem associated with the vehicle must remain unsolved.

Thus, for instance, in a combat vehicle with suspension of the type with an over-hull-mounted firearm or a combat vehicle with said miniturret, the gunner is placed directly under the firearm or gun, while the tank commander has always been given a position where his vision in some direction has been obstructed by the pivot suspension of an elevating mass.

As regards the location of the ammunition, the tank turret is usually chosen, where a hit in the turret, which in itself is not dangerous, with an armour-piercing projectile or a projectile with so-called hollow-charge effect can have a disastrous effect if it hits ammunition which is being carried. In this case, the result can be that the combat vehicle is completely knocked out. Because of this potential danger, it is of importance to have the inflammable parts of the ammunition in a magazine outside the vehicle.

As regards the over-hull-mounted gun vehicles, a small frontal area is provided, but said vehicles have limitations as regards the choice of loading system, and therefore cannot always be utilized.

SUMMARY OF INVENTION

The above problems are solved with the present invention. Thus, the new combat vehicle is provided with an automatic gun with a caliber of 100 mm or larger. Further, the gun is to be equipped with an automatic loading device for separate-loading the ammunition, and the vehicle has a magazine arranged outside of the vehicle chassis for the charges used in the separate-loading ammunition. Essential characteristics of the new combat vehicle also include a crew position high up in the vehicle for good vision around the horizon, and the vehicle has a comparatively small frontal area.

By using separate-loading ammunition, it becomes possible to place the commander's position behind the firearm. Through the use of combustible cartridge cases, the crew position is out of the way of cartridge cases ejected from the firearm.

In further developments of the invention it is also proposed to utilize a sliding-wedge breech mechanism for the gun, and further details in regard to how the loading system is designed to obtain rapid feeding of rounds to the large-caliber gun, which ensures a substantial striking power from the combat vehicle. In these further developments, projectiles or shells carried in the vehicle are stored comparatively low in the turret, in so-called stack magazines.

Also the design of the frontal surface is given.

In addition to the advantages of having good vision in all directions from the vehicle and a small frontal area, a comparatively small target surface is obtained for the magazine for charges arranged outside of the vehicle chassis. Through the use of separate-loading ammunition the outside magazine will be relatively light, and its center of gravity will be relatively close to the center of the vehicle in the longitudinal direction. During driving, the vehicle will not be affected by tipping movements. The sensitive high-explosive shells are placed farthest down in the turret and, for instance, inside the armour-piercing projectiles when this kind of ammunition is carried.

Through the automatic loading device, a good feeding speed for the large-caliber firearm is obtained for the projectile/shell and the charges, without compromising vision, small frontal area, and outside magazines for charges.

BRIEF DESCRIPTION OF DRAWINGS

An embodiment of the invention will be described in more detail with reference to the accompanying drawings, in which.

BEST MODE OF CARRYING OUT THE INVENTION

Figure 1:
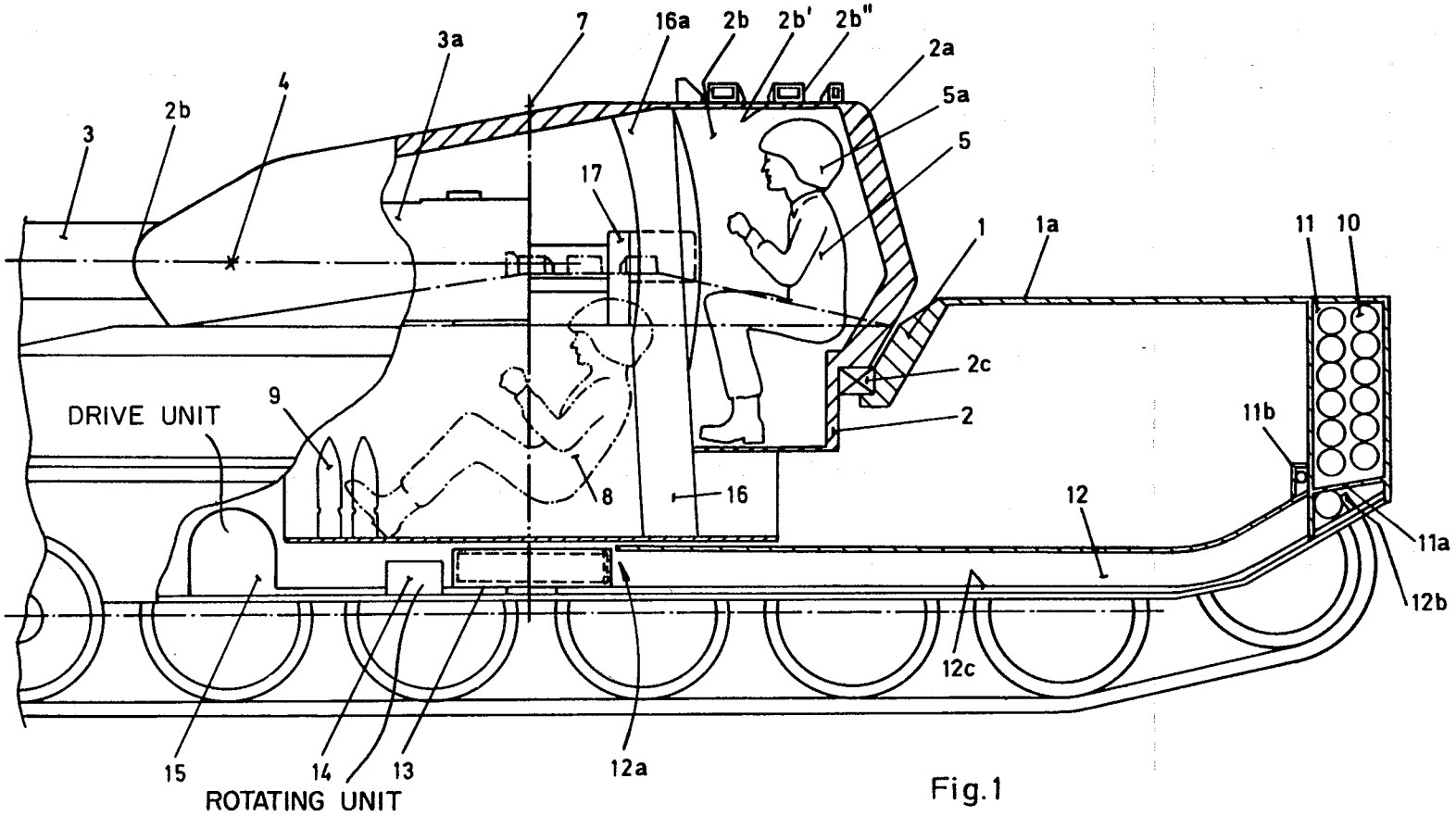
FIG. 1 is a partly longitudinal section showing parts of a combat vehicle.
Figure 2:
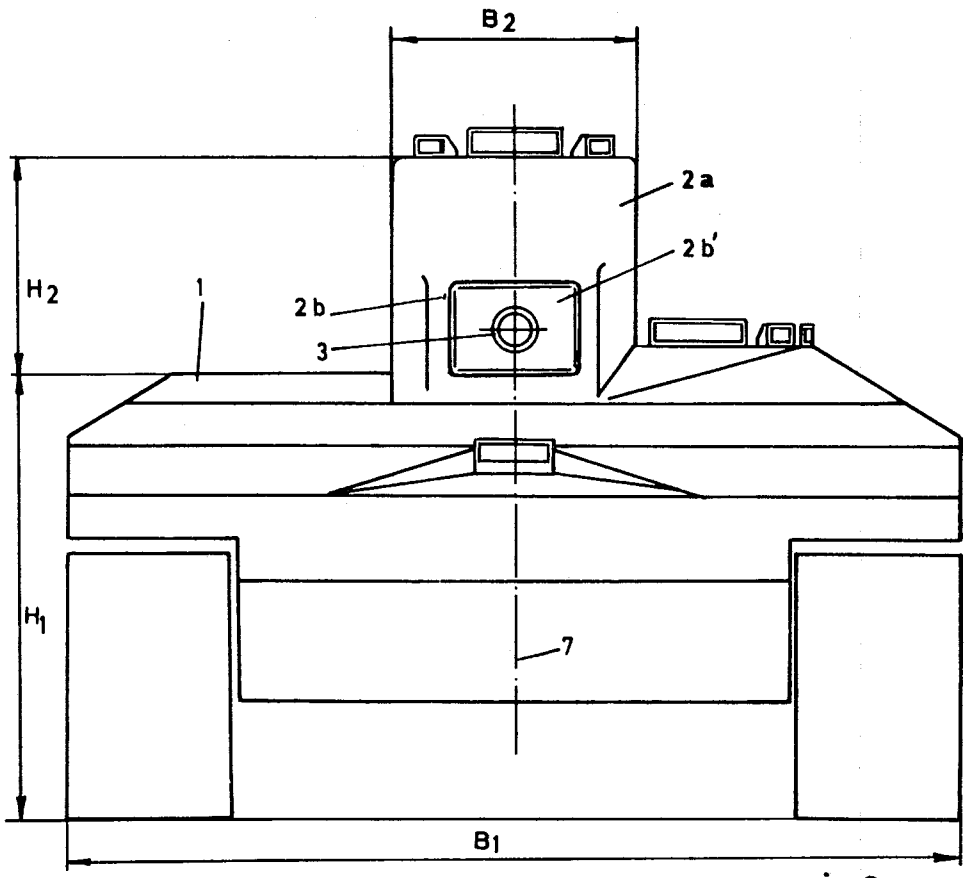
FIG. 2 is a front view of the combat vehicle according to FIG. 1.
Figure 3:
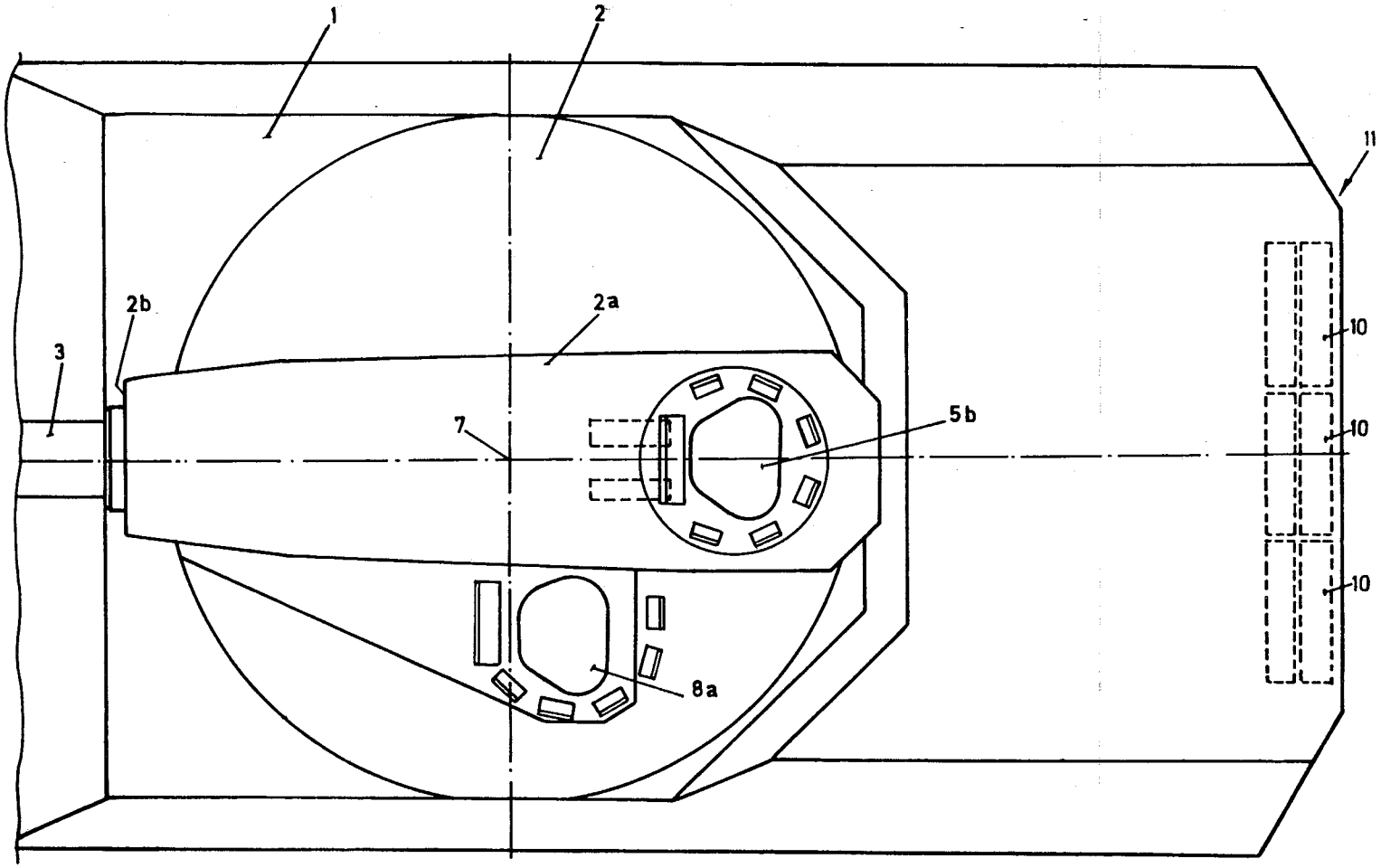
FIG. 3 is a horizontal view of the combat vehicle according to FIGS. 1 and 2, FIGS. 4*a*–4*b* are side and end views of a hoist in the combat vehicle with a car in the lower position or the fetching position.

FIGS. 1–3 show a combat vehicle in the form of a tank 1 from the side, front, and from above. The vehicle is made with a rotatable so-called compact turret 2, which with a long and narrow upper part 2*a*, extends above the rest of the chassis of the vehicle. This upper part is made with a small front section 2*c*, from which the side and top surfaces of the upper part are inclined straight outwards, upwards, and rearwards. A large-caliber firearm 3 in the form of a 105 mm gun is supported in said upper part in a trunnion suspension which is known, and which in FIG. 1 is symbolized by 4. The breech ring of the firearm is shown by 3*a*. The front section 2*b* is provided with an aperture 2*b*', through which the barrel of the firearm extends in the forwards direction and which via the barrel can be elevated and lowered.

The breech ring 3*a* extends rearwards to the front portion of space 2*b* arranged high up in the upper part 2*a* for a position for the vehicle commander. The space 2*b* is located farthest to the rear and highest in the upper part 2*a*, so that a seat 5*b* for the crew position will be in the top portion 1*a* of the vehicle chassis, while the head 5*a* of an individual of normal size will be near the top 2*b*' of the space 2*b*. The space is closed at the rear, and contact with another crew member inside the turret. Viewing means 2*b*'', which are well known, are arranged in the top 2*b*'.

The turret 2 is suspended to rotate around a vertical axis of rotation 7, in a way which is known through a rotatable suspension 2*c* for rotating the firearm. The rotation and elevation functions are achieved in a way which is known.

A space is provided for the vehicle commander 5 which is located at the maximum height in the vehicle, with good observation around the horizon via said viewing means 2''. Good protection is provided by the small frontal area 2*b* of the turret and by the long and narrow upper part of the turret. The long and narrow configuration ensures that the weapon can carry out its recoil movements although the space 2*b* is located directly behind the breech ring.

In the lower parts of the turret, on one side of the firearm, a space has been arranged for a second crew member 8, which seat is indicated by 8*a*. A space located on the other side of the firearm is arranged to contain magazines which are known for warheads in the form of projectiles and/or shells 9. Charges, e.g. bag charges 10, are arranged in a so-called outside magazine 11 farthest to the rear in the vehicle, or in a magazine suspended on the rear which is not shown, arranged behind the chassis at the rear portion of the vehicle. The magazine 11 is assumed to comprise three compartments for charges, and to be made with a common feed-out position 11*a* at the lower portion of the middle compartment. The magazine moreover comprises side displacement means 11*b*, which are known, for transferring the charges from the outer compartments to the middle compartment.

A conveyor 12 leads from the common feed-out position 11*a* to a feeding position 12*a* inside the turret. In the conveyor there are arranged carrier means 12*b* and a pair of guide rails 12*c* on which the charges are rolled over from the magazine to the feeding position 12*a*. The conveyor extends along the floor of the vehicle and centrally along this in a drum-like channel. The conveyor also leads under the turret floor to a rotary table 13 which has a vertical turning axis coinciding with the vertical turning axis 7 of the turret.

In FIG. 1, the rotating means for the rotary table are indicated by 14, and the drives for the carrier means 12*b* by 15.

Inside the turret there is also a hoist comprising a frame 16 supporting a car 17 which can be driven vertically to a lower position or fetching position above the rotary table 13 to transfer a charge to the car 17. Also the shells or projectiles can be transferred to the car 17 in the fetching position. By means of the car 17 the projectile/shell and charge are transported to the breech ring 3*a* of the firearm, where ramming of the projectile/shell and charge takes place. The frame 16 is made with a curved part 16*a* arranged so that ramming can take place independent for angle of elevation of the firearm.

The frame with its car 17 is placed between the breech ring and the front parts of the crew compartment 2*b*.

Figure 4B:
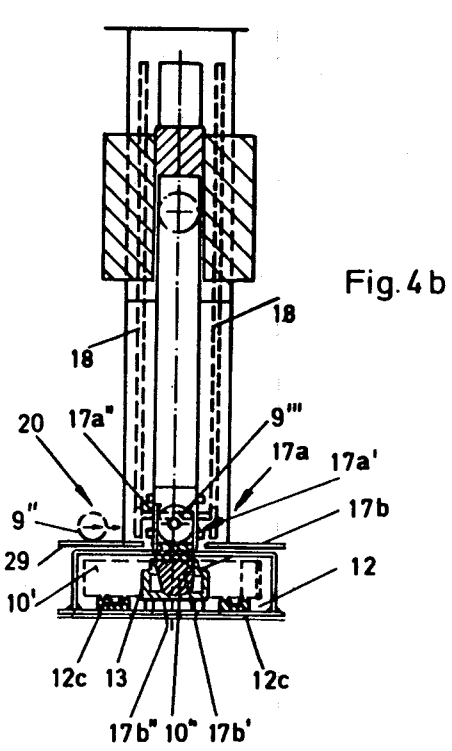
FIG. 4*c* shows a detail of FIG. 4*a*.
Figure 4A:
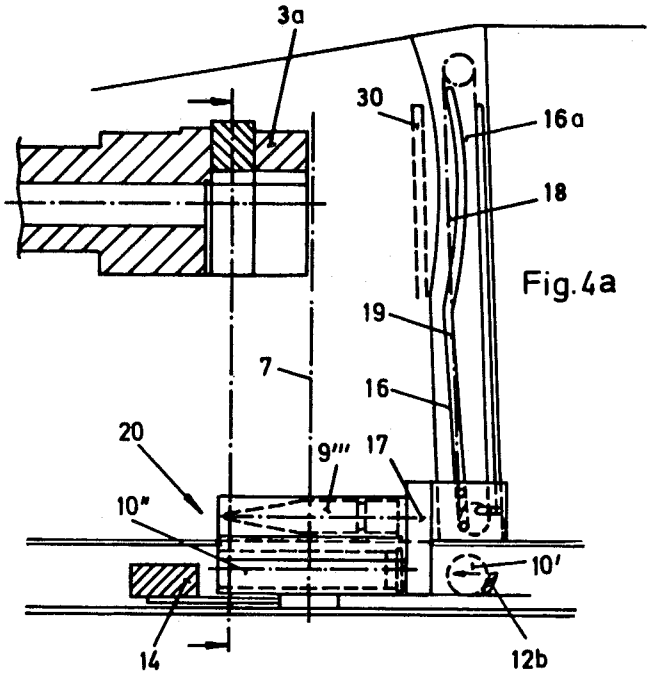
Figure 4C:
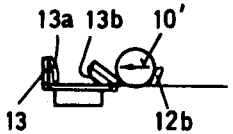
Figure 5:
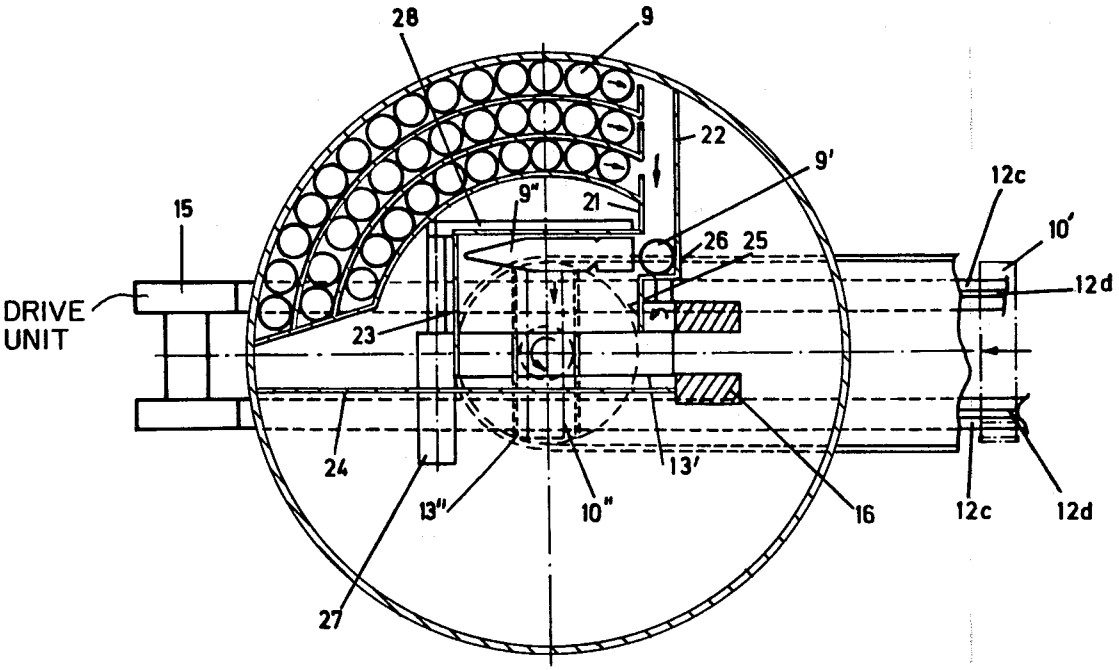
FIG. 5 is a view of an interior of a turret in a combat vehicle according to FIGS. 1–3, FIGS. 6*a*–6*b* show the hoist according to FIGS. 4*a*–4*b*, but with the car in the ramming position behind the breech ring of the barrel.

FIGS. 4*a*–5 show the principle of the transfer of the projectiles/shells and the charges in more detail, as well as the positioning of the projectiles/charges 9 in the turret magazine.

The driving means for the car 17 are symbolized by drive chains 18 on the side parts of the frame, which also comprise guide grooves 19 for determining the tipping position of the car at different height levels, the guide groove being straight at the bottom and curved at the top for adaptation to the different angles of elevation of the gun. FIGS. 4*a* and 4*b* show the car 17 in its lower position, or the fetching position 20. The car has upper and lower supporting and gripping units 17*a* and 17*b*, respectively, which are located on top of each other on the car 17.

FIG. 5 shows how the projectiles/shells 9 are arranged standing on edge in the turret magazine. As feeding devices in such magazines are assumed to be previously well known, they are not shown in detail or discussed here. For forming of feed-out channels, guide walls 21 and 22 are arranged in connection with said magazines. Further guide walls 23, 24, and 25 are arranged in connection with the rotary table 13 which in accordance with FIG. 5 is rotatable around its vertical axis between a first rotating position 13'' where the load-carrying part of the rotary table is set across the longitudinal axis of the vehicle, and a second rotating position 13' where the supporting part of the rotary table coincides with the longitudinal axis of the vehicle. In the first rotating position the rotary table 13 is set to receive a charge 10' fed on the guide rails 12*c* from the magazine 11. In the second rotating position the rotary table has turned the charge thus received to a position where it can be transferred to the hoist 16, 17.

Because of the fact that the projectiles/shells are in an upright position, they must be turned before they can be transferred to the hoist. For this purpose, a projectile/shell turning device 26, which is known, is arranged in connection with the feed-out channel of the turret magazine. In FIG. 5, a projectile/shell fed standing on edge to the turning device 26 is indicated by 9' and a projectile/shell turned down by said turning device 26 is indicated by 9''. The turned down projectile/shell is displaced laterally into the hoist car 17 with the aid of lateral displacement means which in the present case comprise a hydraulic cylinder 27 and a part 28 connected to its piston which can coact with the projectile/shell 9'. Said means 27, 28 move the projectile/shell in, in line with the longitudinal axis of the vehicle. This displacement takes place on a base 29, as shown by FIG. 4*b*.

The supporting unit 17*a* on the car 17 comprises, a tray, the side supports 17*a*' and 17*a*'' which support a projectile/shell 9''' rolled into the supporting unit from the base 29. In order to provide for the rolling in of the projectile/shell 9''' one of the side supports 17*a*'' can be turned down during the rolling-in stage.

The rotary table 13 comprises two opposite longitudinal sides, between which a charge on the rotary table is fixed between two holding springs 13*a*, 13*b* arranged at each longitudinal side and which are arranged so that jaws 17*b*' and 17*b*" in the lower gripping unit can grip the charge 10". In order to permit rolling in from the conveyor 12 one of the longitudinal walls on the rotary table is arranged so that it can be turned down, as shown in FIG. 4*c*.

The projectile/shell 9"' and the charge 10" inserted in the upper and lower supporting and gripping units 17*a* and 17*b*, respectively, can thereafter be transported upwards in the vertical direction, the projectile/shell being located above the charge.

The carriers 12*b* are arranged on belts 12*d* which are supported in said guide rails 12*c* and are driven by the drive means 15.

Figures 6A, 6B, 6C:
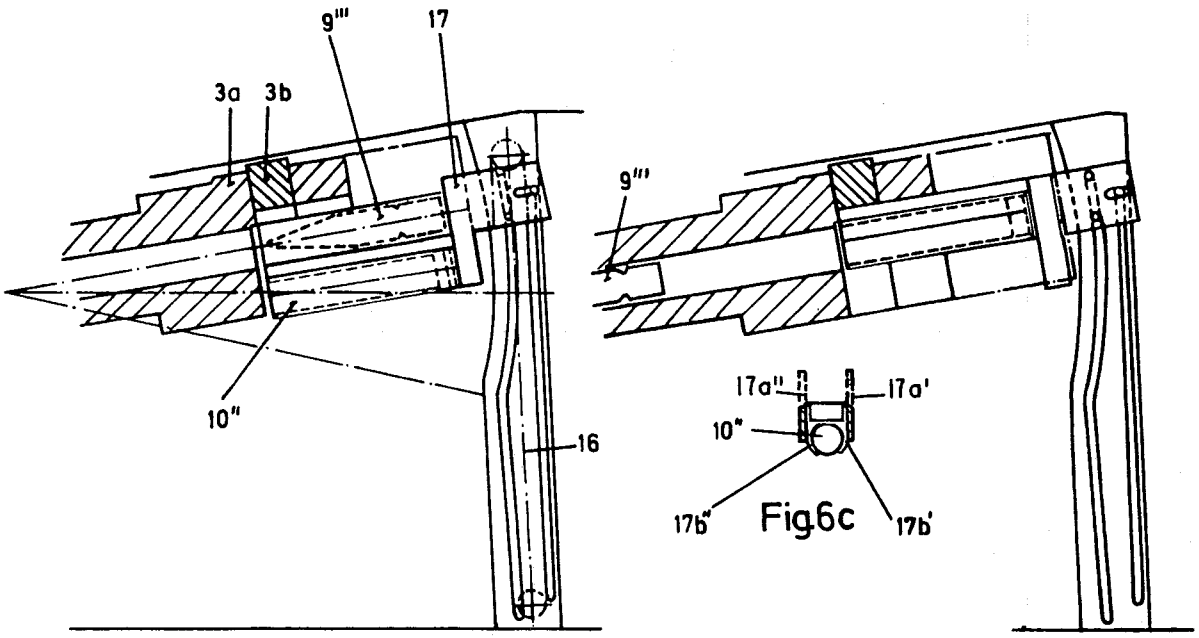
FIG. 6*c* shows a detail of FIG. 6*b*.

FIGS. 6*a* and 6*b* show the ramming when a gun is depressed to the maximum limit. The frame 16 is located so far behind the breech ring of the gun as to permit the recoil movements of the gun. During recoil movements the car 17 is set at its lower positions. FIG. 6*a* shows the position of the car 17 for ramming of the projectile/-shell 9"' and FIG. 6*b* the ramming position for the charge 10", the projectile/shell then having been rammed and which is in the chamber. The ramming means on the firearm can be of a kind which are known in themselves. The projectile/shell and the charge are secured by said supporting and gripping units 17*a* and 17*b*, respectively, in a way that longitudinal displacement can take place. As the ramming means must coact with the projectile/shell from the top, and with the charge from the underside, the ramming means are of the kind equipped with a rotatable claw which can coact with the rear parts of the projectile/shell and the charge, respectively.

In the ramming position, the side parts or the supports 17*a*' and 17*a*" in the supporting part 17*a* can be turned outwards, see FIG. 6*c*, to permit continued pushing up of the car 17 after the projectile/shell has been rammed and the charge 10" is to be moved up in line with the extension of the axis of the bore. The jaws 17*b*' and 17*b*" can of course be opened in the fetching position 20 of the car to permit gripping of the charge 10".

Through the loading device, the charges are transferred one after another to the rotary table, which is thereafter turned in line with the longitudinal axis of the vehicle. The car 17 is set in the fetching position 20, and both the projectile/shell and the charge are transferred to the car, which is thereafter actuated to the ramming position, where ramming can take place. After the ramming, the car returns to the fetching position.

The control and co-ordination of the various units and functions in the loading device described above for separate-loading ammunition can be made so that an optimized transfer of rounds from the magazines to the gun can be achieved.

In accordance with FIGS. 6*a* and 6*b*, the gun is of the kind which utilizes a sliding-wedge breech mechanism 3*b*. The sliding-wedge breech mechanism can be used in more limited spaced in the turret than, for instance, a screw mechanism. The latter would necessitate larger dimensions of the high turret part 2*a*.

However, the use of the sliding-wedge breech mechanism requires the use of cartridge case flanges at the rear of the charges. In order to prevent the cartridge case flanges from hitting the commander 5 a catching device for the cartridge case flanges is utilized. For the sake of clearness, said catching device is only symbolically indicated in FIG. 4*a*, where it has the designation 30. The catching device is made so that it can spring or be turned aside when the car is moved to the ramming position. The springing or turning aside of the catching device can be controlled with the aid of the movements of the car. The catching device deflects the cartridge case flanges down towards the turret floor, where they can be caught up in a special basket.

With the design described above, a small frontal area of the combat vehicle can be obtained. In principle, the frontal area can be considered to consist of a substantially rectangular first section set on its low edge, and on top of this a centrally arranged rectangular or square second section. The first section preferably has a total area of 5–6 $m^2$, but can be within the range of 4–8 $m^2$. The corresponding values for the second section are approx. 0.7 $m^2$, and 0.5–1.0 $m^2$, respectively. The first section is formed by the width B1 and the height H1 in FIG. 2. The second section is formed in the corresponding way by the height H2 and the width B2.

The vehicle commander 5 has a position above the elevating mass, and his vision will not be obstructed by the elevating mass in any direction. He maintains good visual contact inside the turret with the crew member 8, who can serve as driver and gunner. The inflammable ammunition is placed far away from the crew, and even if the comparatively well protected ammunition charges at the rear portion of the vehicle should be subjected to a hit, the damage arising from this will be limited, and will not interfere with the other functions within the vehicle. The magazine 11 can be provided with blow-out walls which further reduce the damage. The location of the shells and projectiles in the lowermost portion of the turret make them difficult to hit. Notwithstanding the above-mentioned advantages, the vehicle can be equipped with a large-caliber firearm and with an efficient automatic loading system, for separate-loading ammunition.

The invention is not limited to the embodiments shown in the above example, but can be subject to modifications within the scope of the following claims.

I claim:

1. A track driven combat vehicle comprising:

a track driven mechanism supporting a lower chassis for movement in a longitudinal direction, said lower chassis including at a rear portion thereof a magazine for holding explosive ammunition units, a conveyor for receiving ammunition units from said magazine and delivering said ammunition units to a forward position along said chassis to a rotary table for rotating said ammunition units;

a turret mechanism centrally located for rotation about said chassis including a front portion narrower in width than in length for presenting a minimum target area;

said front portion including a breech loading firearm, and a rear portion of said turret including a compartment for supporting a crew member, a turret magazine located above said rotary table;

means for positioning a vertically oriented projectile in said turret magazine to a lateral position;

a hoist car vertically supported for movement in a vertically extending frame from a position for receiving an ammunition unit from said table, and a projectile in said lateral position, to a breech loading position of said firearm, whereby the vulnerability of a hit to said vehicle is minimized by maintaining the bulk of explosive ammunition units at the rear of said vehicle, and the probability of a hit to said turret is minimized by said front portion presenting a minimum target area.

2. A combat vehicle according to claim 1 wherein the firearm has a sliding-wedge breech mechanism and that the ammunition units comprises charges provided with cartridge case flanges.

3. A combat vehicle according to claims 1 or 2, wherein said rotatable turret has a narrow upper part extending above the chassis of the vehicle, said crew rear compartment is farthest to the rear and elevated in said upper part, and the firearm is supported in said upper part so that a breech ring is located inside the upper part where it extends rearwards towards the front parts of said compartment allotted to the crew position.

4. A combat vehicle according to claim 1 wherein the frame has a curved upper part which enables ramming components from said car into said firearm in various elevation positions of the firearm.

5. A combat vehicle according to claim 1 wherein said vehicle has a frontal area comprising: a rectangular first section, and on top of said first section a centrally arranged rectangular or square second section, said first section having an area of 4–8 $m^2$, and said second section has an area of 0.5–1.0 $m^2$.

6. A combat vehicle according to claim 1 wherein said car includes a supporting unit, located above a gripping unit, said units being positioned with respect to said car whereby an ammunition unit can be transferred from said table to said gripping unit, and a projectile transferred to said supporting unit when said car is in the lower-most position with respect to said frame, whereby said car bearing said projectile and ammunition unit can vertically move to a position for loading into said firearm.

* * * * *